US007663568B2

(12) United States Patent
Yuba et al.

(10) Patent No.: US 7,663,568 B2
(45) Date of Patent: Feb. 16, 2010

(54) ANTENNA APPARATUS

(75) Inventors: Takashi Yuba, Shinagawa (JP); Shigemi Kurashima, Shinagawa (JP); Hideki Iwata, Shinagawa (JP); Masahiro Yanagi, Shinagawa (JP); Takashi Arita, Shinagawa (JP); Toshihiro Kusagaya, Shinagawa (JP); Kazuhiko Ikeda, Iiyama (JP); Hiroshi Matsumiya, Iiyama (JP); Kazuo Nomura, Iiyama (JP)

(73) Assignee: Fujitsu Component Limited, Tokyo (JP)

( * ) Notice: Subject to any disclaimer, the term of this patent is extended or adjusted under 35 U.S.C. 154(b) by 237 days.

(21) Appl. No.: 11/802,903

(22) Filed: May 25, 2007

(65) Prior Publication Data

US 2008/0055183 A1 Mar. 6, 2008

(30) Foreign Application Priority Data

Aug. 31, 2006 (JP) ..... 2006-235536
Mar. 29, 2007 (JP) ..... 2007-088780

(51) Int. Cl.
*H01Q 1/40* (2006.01)

(52) U.S. Cl. ..... 343/846; 343/795; 343/873

(58) Field of Classification Search ..... 343/700 MS, 343/846, 892, 893, 795, 872, 873, 906
See application file for complete search history.

(56) References Cited

U.S. PATENT DOCUMENTS 4,605,933 A * 8/1986 Butscher ..... 343/700 MS
5,943,020 A * 8/1999 Liebendoerfer et al. ..... 343/702
6,037,912 A * 3/2000 DeMarre ..... 343/815

FOREIGN PATENT DOCUMENTS

JP 2000-196327 7/2000

OTHER PUBLICATIONS

Takuya Taniguchi et al., An Omnidirectional and Low-VSWR Antenna for the FCC-Approved UWB Frequency Band, 2003, General Conference of the Institute of Electronics, Information, and Communication Engineers, p. 133.

* cited by examiner

*Primary Examiner*—Michael C Wimer
(74) *Attorney, Agent, or Firm*—Staas & Halsey LLP

(57) ABSTRACT

An antenna apparatus is disclosed that includes a synthetic resin case having an antenna element accommodating portion and a ground element accommodating portion, an antenna element made of punched sheet metal that is accommodated within the antenna element accommodating portion, a ground element made of punched sheet metal that is accommodated within the ground element accommodating portion and aligned with the antenna element, a surface mount coaxial connector that is mounted over an interface between the antenna element and the ground element, and a cover that covers the antenna element and the ground element.

8 Claims, 14 Drawing Sheets

ANTENNA APPARATUS

CROSS REFERENCE TO RELATED APPLICATIONS

The present application is based on and claims the benefit of the earlier filing dates of Japanese Patent Application No. 2006-235536 filed on Aug. 31, 2006, and Japanese Patent Application No. 2007-088780 filed on Mar. 29, 2007, the entire contents of which are hereby incorporated by reference.

BACKGROUND OF THE INVENTION

1. Field of the Invention

The present invention relates to a planar antenna apparatus that uses UWB (ultra-wide band) and a method for fabricating such an antenna apparatus.

2. Description of the Related Art

In recent years and continuing, much attention is being focused on UWB as a wireless communications technology enabling radar positioning and broadband communications, for example. In 2002, the U.S. Federal Communication Commission (FCC) approved usage of the UWB within a frequency band of 3.1-10.6 GHz.

The UWB is a wireless communications technology that involves transmitting pulse signals across a very wide frequency band. Therefore, an antenna used for UWB communication has to be capable of transmitting and receiving signals within a very wide frequency band.

It is noted that in "An Omnidirectional and Low-VSWR Antenna for the FCC-Approved UWB Frequency Band" by Takuya Taniguchi and Takehiko Kobayashi (The 2003 IECIE General Conference, B-1-133), an antenna adapted for use in the FCC-approved frequency band of 3.1-10.6 GHz is disclosed that comprises a ground plane and a feed element.

FIGS. 1A and 1B are diagrams showing examples of conventional antenna apparatuses. The antenna apparatus 10 shown in FIG. 1A includes a ground plane 11 and a feed element 12 having a circular cone shape that is arranged on the ground plane 11. The circular cone shape of the feed element 12 is arranged such that the side face forms an angle of θ degrees with respect to the axis of the cone. It is noted that desired antenna properties may be obtained by adjusting the angle θ.

The antenna 20 shown in FIG. 1B includes a ground plane 11 on which a conical part 22*a* and a spherical part 22*b* internally touching the conical part 22*a* are arranged, the conical part 22*a* and the spherical part 22*b* forming a tear-shaped feed element 22.

As is described above, a conventional broadband antenna apparatus is constructed by arranging a cone-shaped or tear-shaped feed element on a flat ground plane. The antenna apparatus constructed in such a manner is rather large so that techniques for miniaturizing and flattening the antenna apparatus are in demand.

SUMMARY OF THE INVENTION

According to an embodiment of the present invention, an antenna apparatus is provided that includes:

a synthetic resin case having an antenna element accommodating portion and a ground element accommodating portion;

an antenna element made of punched sheet metal that is accommodated within the antenna element accommodating portion;

a ground element made of punched sheet metal that is accommodated within the ground element accommodating portion and aligned with the antenna element;

a surface mount coaxial connector that is mounted over an interface between the antenna element and the ground element; and a cover that covers the antenna element and the ground element.

According to another embodiment of the present invention, a method for fabricating an antenna apparatus is provided, the method including the steps of:

embedding an antenna element made of punched sheet metal and a ground element made of punched sheet metal in a synthetic resin case by accommodating the antenna element within an antenna element accommodating portion of the synthetic resin case, accommodating the ground element within a ground element accommodating portion of the synthetic resin case, and aligning the antenna element and the ground element;

mounting a surface mount coaxial connector over an interface between the antenna element and the ground element; and covering the antenna element and the ground element with a cover.

DESCRIPTION OF THE PREFERRED EMBODIMENTS

In the following, preferred embodiments of the present invention are described with reference to the accompanying drawings.

Figure 1A:
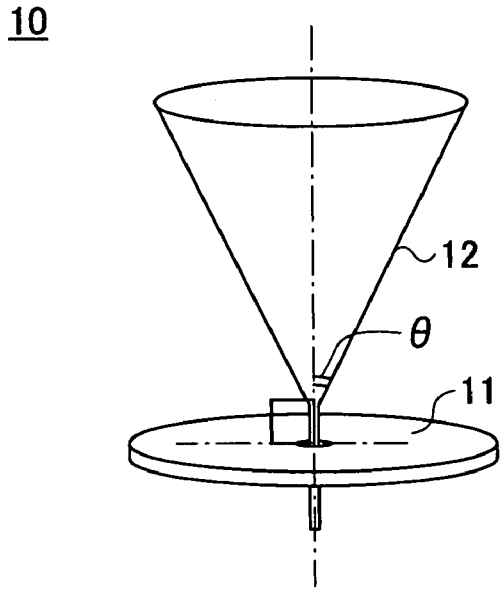
FIG.1A PRIOR ART
FIGS. 1A and 1B are diagrams showing exemplary configurations of antenna apparatuses according to the prior art.
Figure 1B:
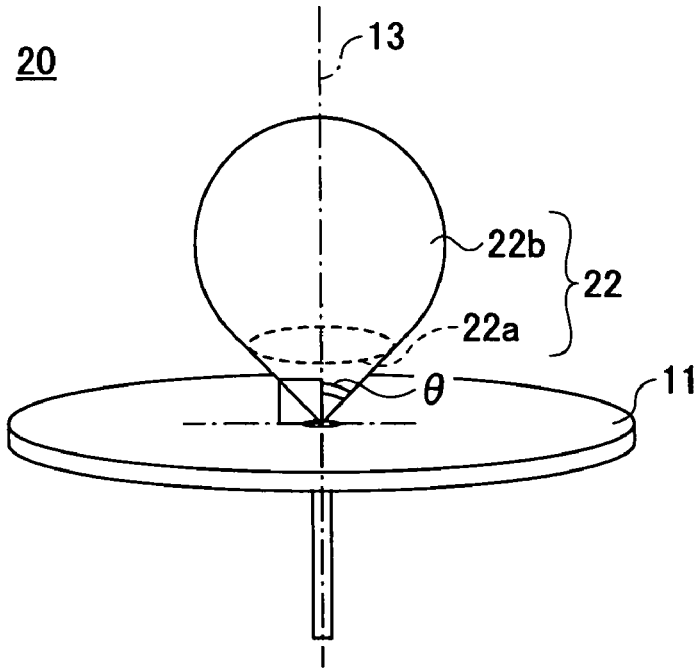
FIG.1B PRIOR ART
Figure 2A:
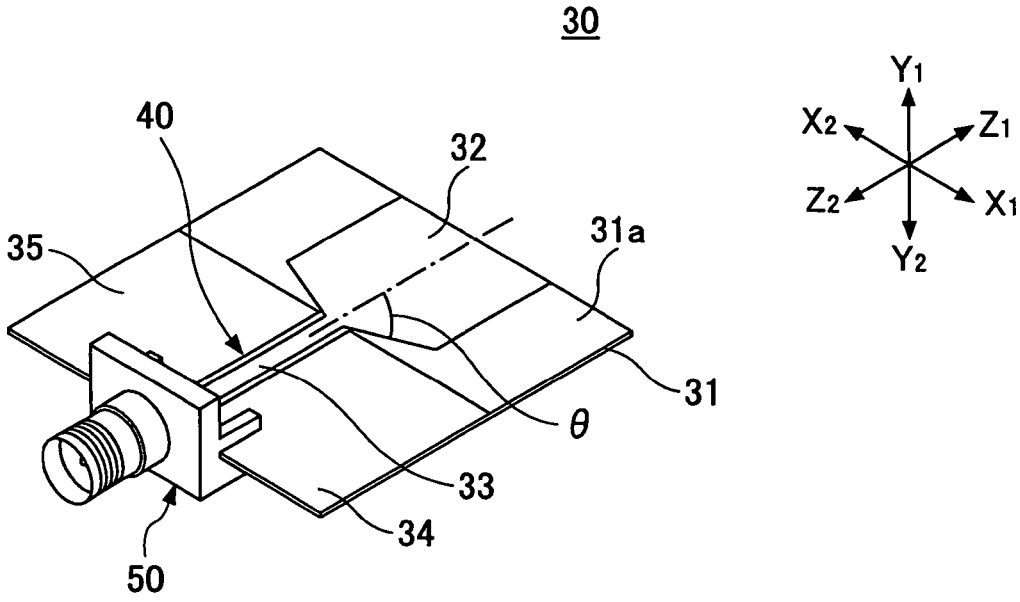
FIGS. 2A and 2B are diagrams showing a basic configuration of UWB planar antenna apparatus.
Figure 2B:
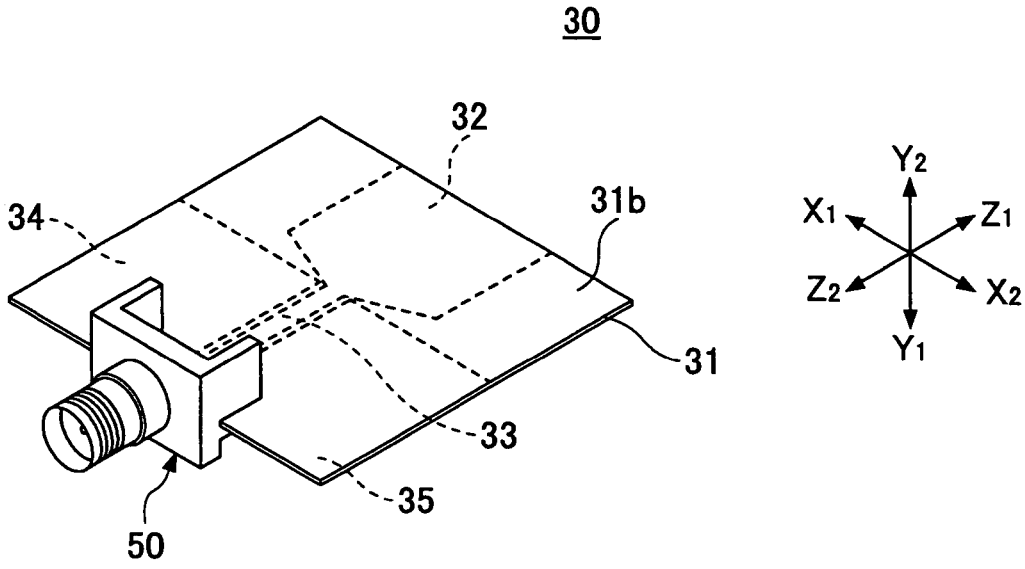

FIGS. 2A and 2B are diagrams showing a basic configuration of an exemplary UWB planar antenna apparatus. As can be appreciated from these drawings, the illustrated UWB planar antenna apparatus 30 is reduced in size and thickness compared to the conventional antenna apparatuses 10 and 20 shown in FIGS. 1A and 1B.

The UWB planar antenna apparatus 30 includes a dielectric base 31 having an upper face 31*a* on which an antenna element pattern 32, a strip line 33, and two ground patterns 34 and 35 are formed. The UWB planar antenna apparatus 30 has a coaxial connector 50 attached to an edge of the base 31.

The strip line 33, the ground patterns 34 and 35 arranged at the sides of the strip line 33, and the base 31 form a microwave transmission line 40. The coaxial connector 50 is fixed to the end of the microwave transmission line 40 by being soldered to the strip line 33 and ground patterns 34 and 35.

It is noted that vapor deposition and etching have to be performed in order to create the antenna element pattern 32, the strip line 33, and the ground patterns 34 and 35 of the UWB planar antenna apparatus 30. Since vapor deposition and etching include many process steps, it has been difficult to reduce costs for fabricating the UWB planar antenna apparatus.

Embodiment 1

Figure 3A:
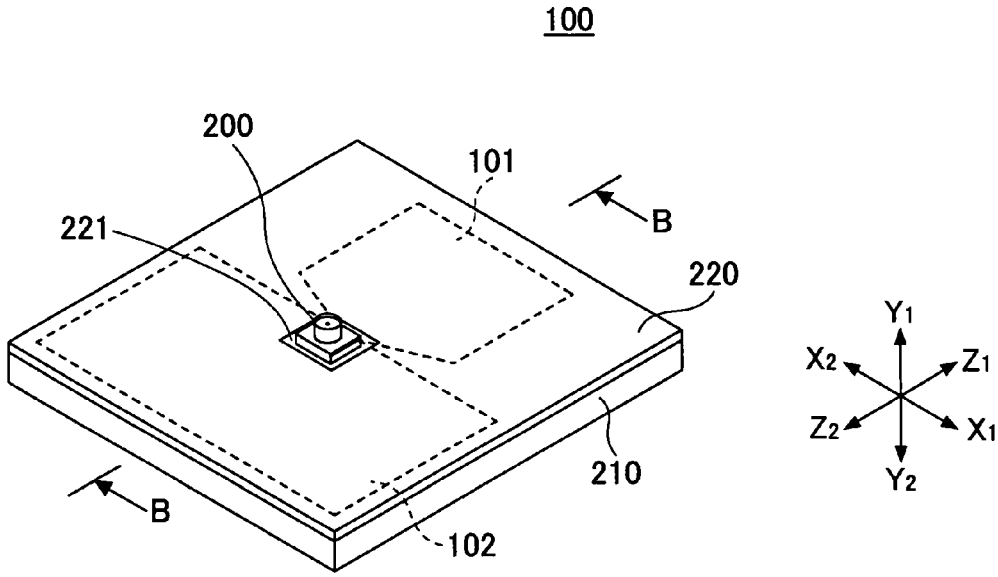
FIGS. 3A-3C are diagrams showing a configuration of a UWB planar antenna apparatus according to an embodiment of the present invention.
Figure 3B:
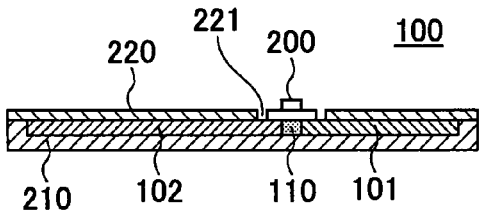
Figure 3C:
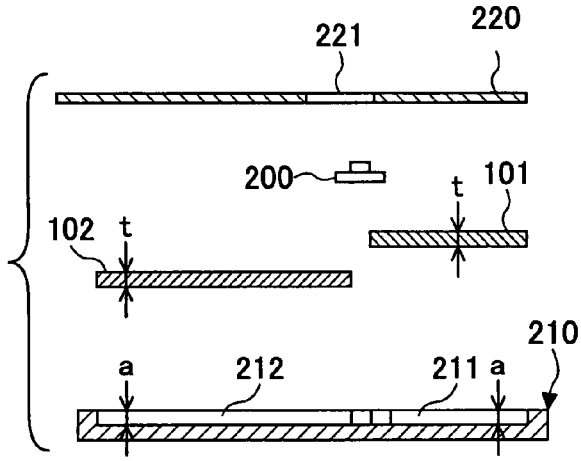

FIGS. 3A, 3B, and 3C are diagrams showing a UWB planar antenna apparatus according to an embodiment of the present invention. Specifically, FIG. 3A is a perspective view of the UWB planar antenna apparatus, FIG. 3B is a cross-sectional view of the UWB planar antenna apparatus cut across line B-B of FIG. 3A, and FIG. 3C is an exploded cross-sectional side view of the UWB planar antenna apparatus cut across the line B-B and viewed in the direction indicated by the arrows shown in FIG. 3A.

The illustrated UWB planar antenna apparatus 100 includes a punched copper sheet antenna element 101 instead of an antenna element pattern and a punched copper sheet ground element 102 instead of a ground pattern. The antenna element 101 and the ground element 102 are arranged on a synthetic resin molded case 210 and covered by a synthetic resin molded cover 220. The UWB antenna apparatus 100 also has a surface mount socket coaxial connector 200 arranged over an interface between the antenna element 101 and the ground element 102 and protruding out of the cover 220.

In the following, the structure of the UWB planar antenna apparatus 100 and the process steps involved in constructing the UWB planar antenna apparatus 100 are described.

Figure 4:
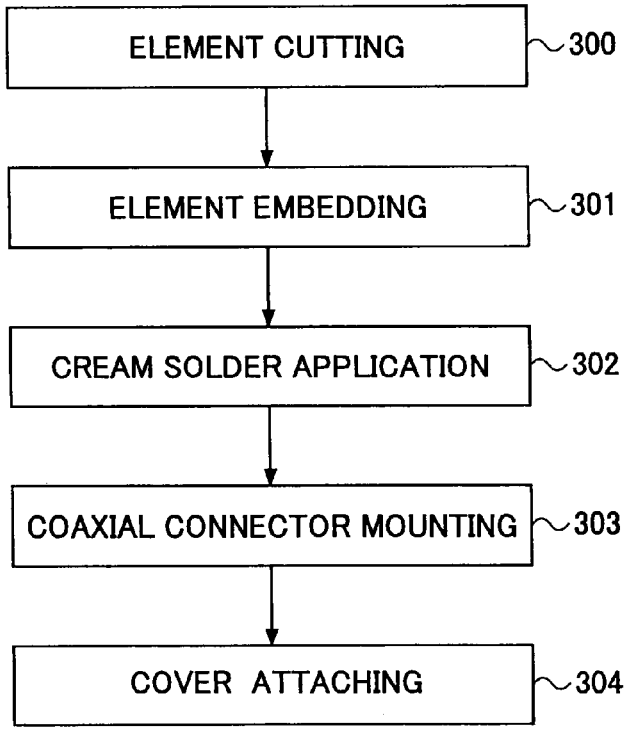
FIG. 4 is a flowchart illustrating process steps for constructing the UWB planar antenna apparatus shown in FIGS. 3A-3C.

FIG. 4 is a flowchart illustrating the process steps for constructing the UWB planar antenna apparatus 100.

(1) Element Cutting Step 300

Figure 5:
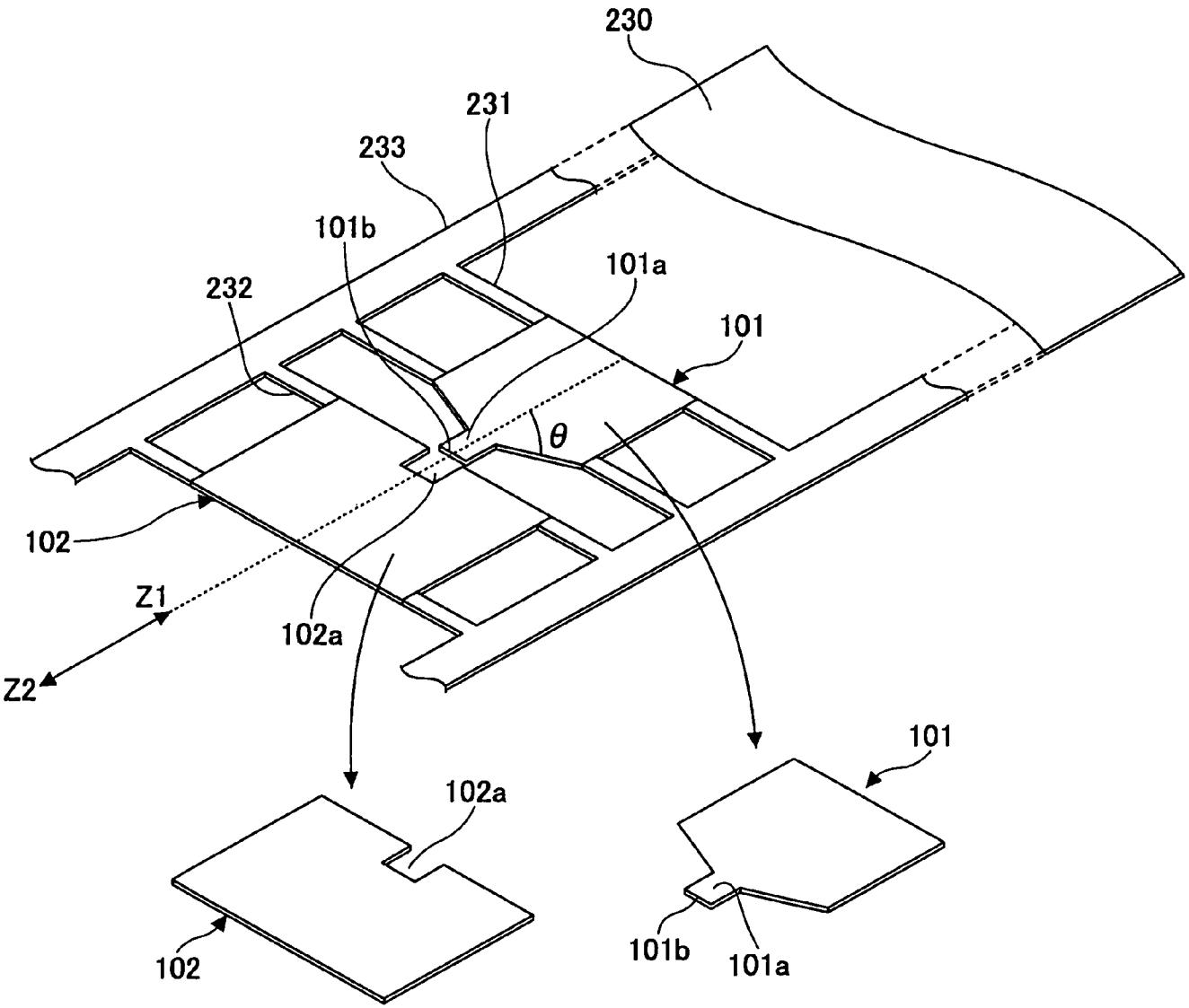
FIG. 5 is a diagram illustrating an element cutting step.

FIG. 5 is a diagram illustrating an element cutting step 300 of FIG. 4. As is shown in this drawing, a copper coil strip member 230 is punched to create the antenna element 101 and the ground element 102. The antenna element 101 and the ground element 102 are connected to a frame 233 by bridges 231 and 232, respectively.

The antenna element 101 is arranged into a home base shape. The opening angle of the protruding portion (power supply point) 101*a* of the antenna element 101 is approximately 60 degrees. A strip line 101*b* extends from this protruding portion 101*a* in the direction of arrow Z2 for a length of approximately 1 mm.

The ground element 102 is arranged into a rectangular shape and has a concave portion 102*a* formed at the center of one of its sides (Z1 side).

The antenna element 101 and the ground element 102 may be cut out by breaking the connection with the bridges 231 and 232.

(2) Element Embedding Step 301

Figure 6:
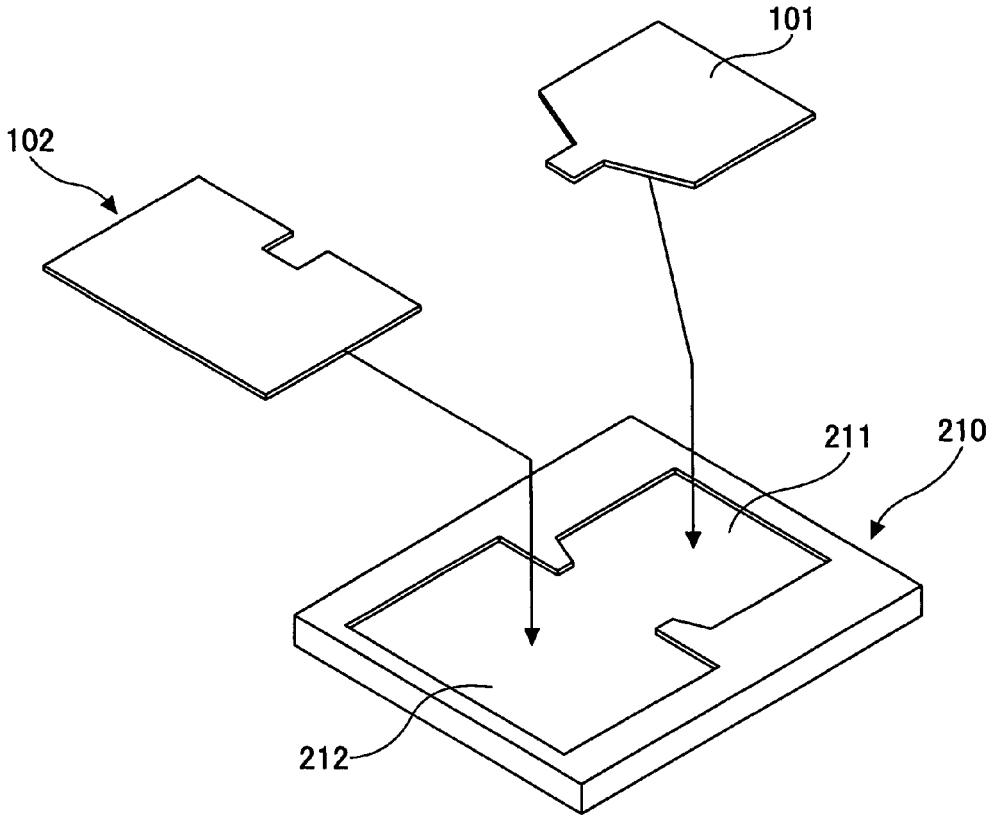
FIG. 6 is a diagram illustrating an element embedding step.

The case 210 may be an ABS resin molded article, for example, that has pockets 211 and 212 for accurately embedding the antenna element 101 and the ground element 102 at predetermined positions as is shown in FIG. 6 and FIG. 3C.

The pockets 211 and 212 are arranged into shapes corresponding to those of the antenna element 101 and the ground element 102, respectively. Also, the pockets 211 and 212 are arranged to have depth 'a', which is equal to thickness 't' of the antenna element 101 and the ground element 102.

As is shown in FIG. 6, the antenna element 101 embedded in the pocket 211, and the ground element 102 is embedded in the pocket 212.

Figure 7A:
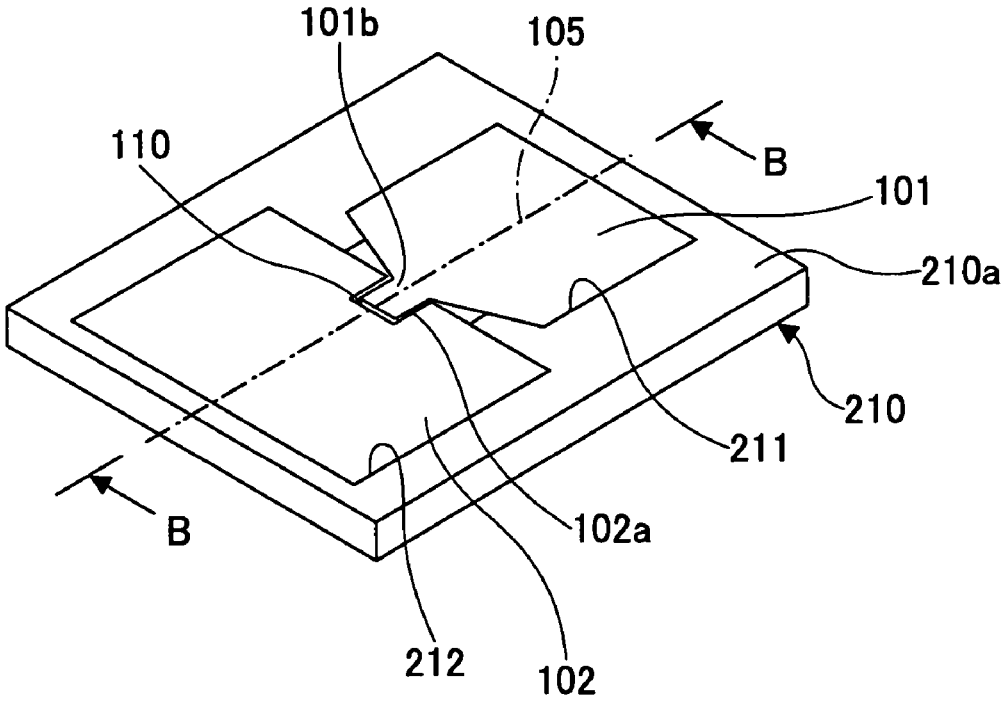
FIGS. 7A and 7B are diagrams illustrating a process stage in which an antenna element and a ground element are embedded into a case.
Figure 7B:
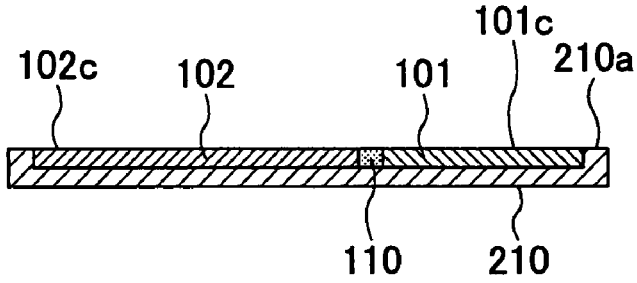

FIGS. 7A and 7B are diagrams illustrating a process stage at which the antenna element 101 is bonded to and embedded in the pocket 211 and the ground element 102 is bonded to and embedded in the pocket 212. It is noted that the antenna element 101 is positioned by the pocket 211, and the ground element 102 is positioned by the pocket 212. The protruding portion (power supply point) 101*a* of the antenna element 101 and the ground element 102 are arranged to close in on each other so that the strip line 101*b* engages the concave portion 102*a* of the ground element 102. In this way, the antenna element 101 and the ground element 102 may be aligned along a monopole axis line 105. Also, adhesive 110 is filled into the gap between the strip line 101*b* and the concave portion 102*a* so that the antenna element 101 and the ground element 102 may be isolated. It is noted that the surfaces of the antenna element 101 and the ground element 102 are arranged to be coplanar with the surface of the case 210 as is shown in FIG. 7B.

(3) Cream Solder Application Step 302

Figure 8:
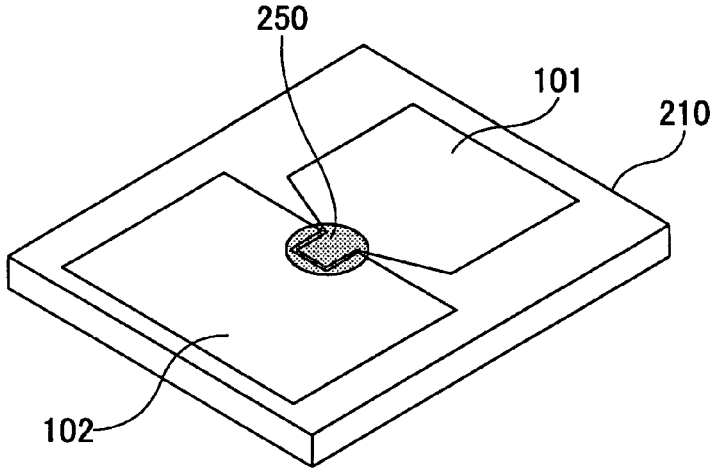
FIG. 8 is a diagram illustrating a cream solder application step.

As is shown in FIG. 8, cream solder 250 is applied to the strip line 101*b* of the antenna element 101 and the concave portion 102*a* of the ground element 102.

Alternatively, conductive adhesive may be applied to the strip line 101*b* and the concave portion 102*a* instead of the cream solder 250, for example.

(4) Socket Coaxial Connector Mounting Step 303

Figure 9A:
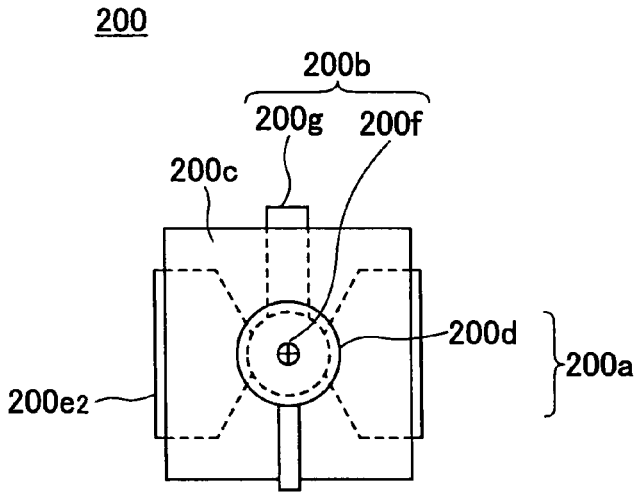
FIGS. 9A-9C are diagrams showing a socket coaxial connector.
Figure 9B:
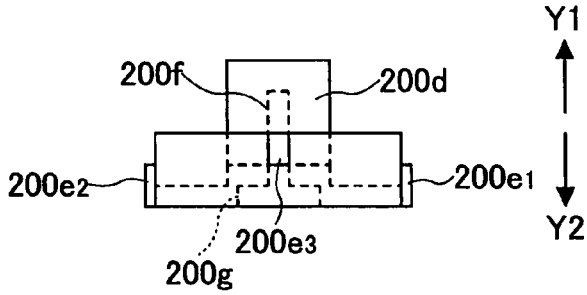
Figure 9C:
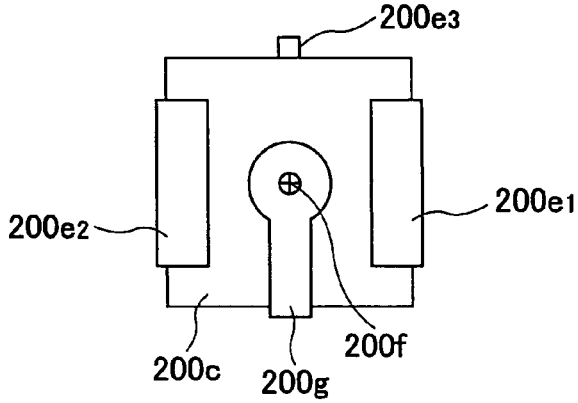
Figure 10:
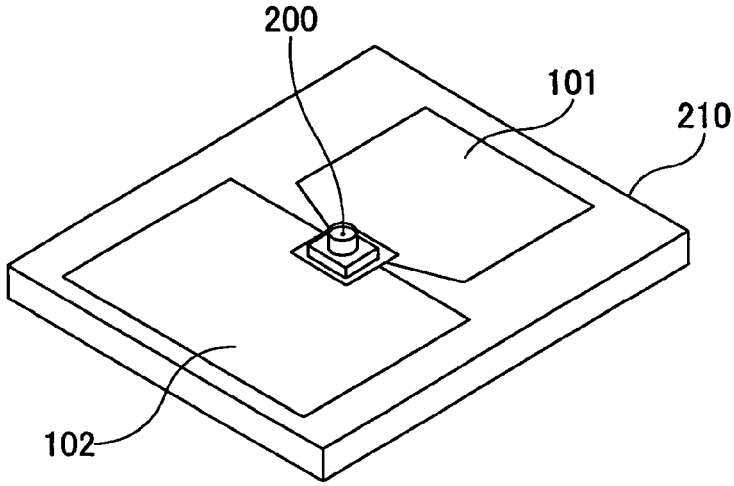
FIG. 10 is a diagram illustrating a socket coaxial connector mounting step.

FIGS. 9A-9C are diagrams showing the socket coaxial connector 200. The illustrated socket coaxial connector 200 is a surface mount connector that is created by integrally molding a shield portion 200*a* and a signal line connect portion 200*b* with an insulating portion 200*c*.

The shield portion 200*a* is made of conductive material and includes a connect portion 200*d*, and contact portions 200*e*1, 200*e*2, and 200*e*3. The connect portion 200*d* is arranged into a substantially cylindrical structure that extends in the direction of arrow Y1 to engage the shield of a plug connector. The contact portions 200*e*1, 200*e*2, and 200*e*3 are connected to the connect portion 200*d* and exposed through the insulating portion 200*c* at the bottom face (Y2 direction side face) of the insulating portion 200*c*.

The signal line connect portion 200*b* is made of conductive material and includes a connection pin (center conductor) 200*f* and a contact portion 200*g*. The center conductor 200*f* is positioned at the center of the connect portion 200*d* and extends in the Y1 direction from the Y2 side of the insulating portion 200*c* within the connect portion 200*d*. The center conductor 200*f* is configured to be connected to a signal line of a plug connector when such a plug connector is connected to the present socket coaxial connector 200. The contact portion 200*g* is connected to the center conductor 200*f* and is exposed through the insulating portion 200*c* at the bottom face (Y2 side face) of the insulating portion 200*c*.

The socket coaxial connector 200 may be mounted over an interface between the antenna element 101 and the ground element 102 by a reflow process, for example. The contact portion 200*g* is soldered to the protruding portion 101*a* of the antenna element 101, and the contact portions 200*e*1 and 200*e*2 are soldered to the portion around the concave portion 102*a* of the ground element 102, for example.

(5) Cover Attaching Step 304

Figure 11:
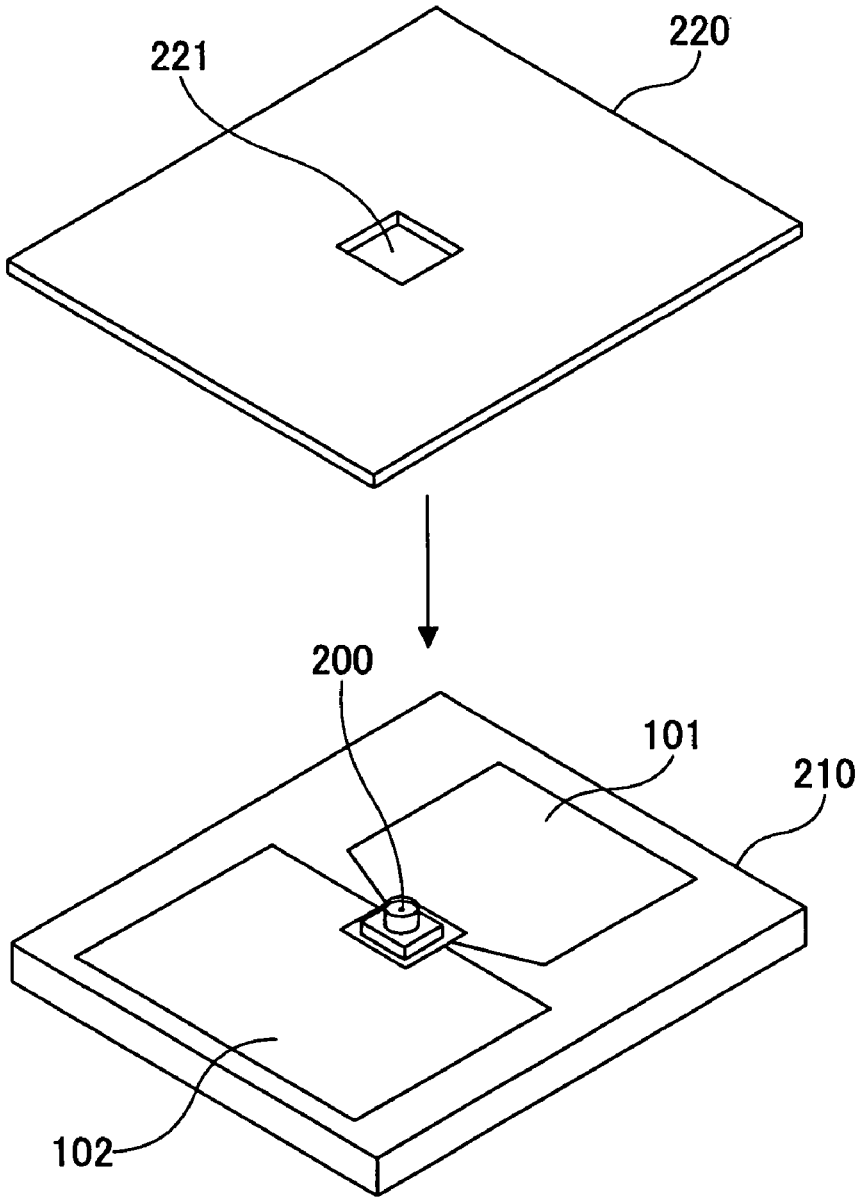
FIG. 11 is a diagram illustrating a cover attaching step.

The cover 220 may be an ABS resin molded article, for example, that has an opening 221 from which the socket coaxial connector 200 may protrude as is shown in FIG. 11 and FIG. 3B.

The cover 220 is placed on the case 210 so that the opening 221 may properly engage the socket coaxial connector 200 and the peripheral portions of the cover 220 are adhered to the case 210.

In this way, the cover 220 covers the antenna element 101 and the ground element 102 while the socket coaxial connector 200 protrudes from the opening 221 of the cover 220 as is shown in FIGS. 3A and 3B, and the process of constructing the UWB planar antenna 100 is hereby completed.

It is noted that in alternative embodiments, the cover 220 and the case 210 may be attached by supersonic wave bonding, thermo compression bonding, double-stick tape, or screws, for example.

Also, the gap between the strip line 101*b* of the antenna element 101 and the concave portion 102*a* of the ground element 102 may alternatively be an empty space, for example, as long as isolation is realized between the antenna element and the ground element 102.

Modified Embodiments

Figure 12A:
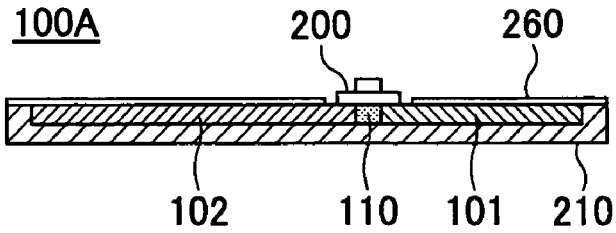
FIGS. 12A and 12B are diagrams showing UWB planar antenna apparatuses according to modified embodiments of the present invention.

FIG. 12A is a cross-sectional view of a UWB planar antenna apparatus 100A according to a modified embodiment of the UWB planar antenna apparatus 100. In this embodiment, instead of the synthetic resin molded cover 220, an insulating layer 260 is laminated over the antenna element 101 and the ground element 102.

Figure 12B:
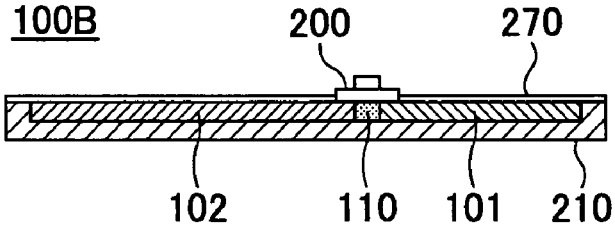

FIG. 12B is a cross-sectional view of a UWB planar antenna apparatus 100B according to another modified embodiment of the UWB planar antenna apparatus 100. In this embodiment, instead of the synthetic resin molded cover 220, an insulating film 270 is formed by applying an insulating material on the antenna element 101 and the ground element 102.

Embodiment 2

Figure 13A:
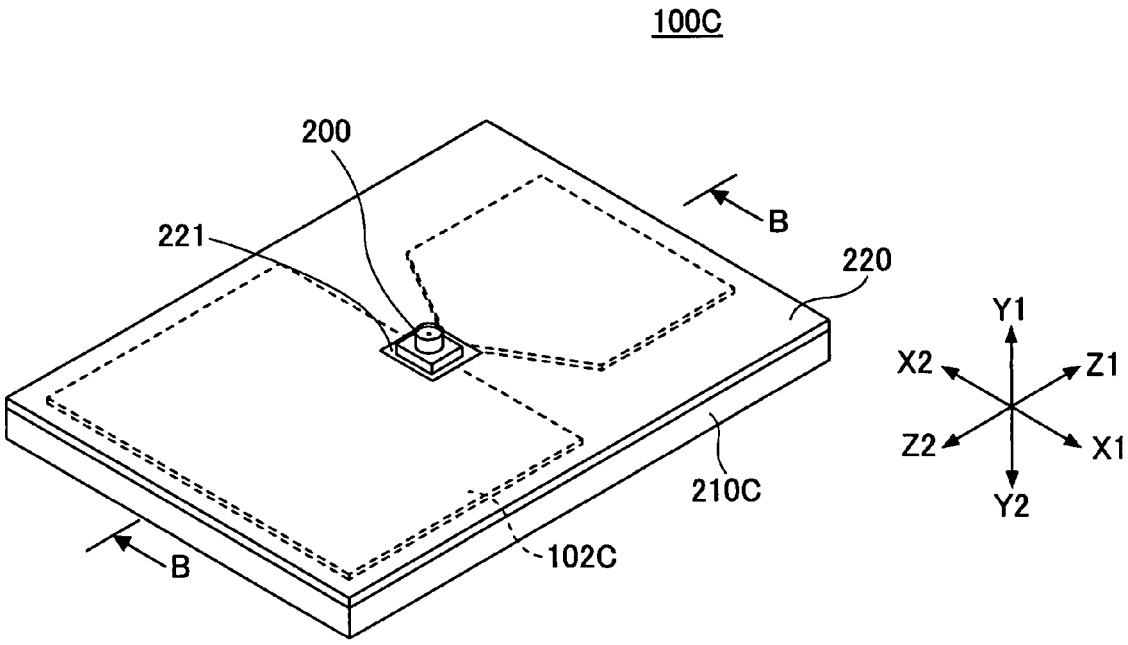
FIG. 13A is a perspective view of the UWB planar antenna apparatus according to another embodiment.
Figure 13B:
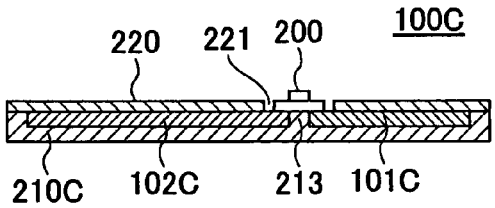
FIG. 13B is a cross-sectional view of the UWB planar antenna apparatus in FIG. 13A, cut across line B-B in FIG. 13A.
Figure 13C:
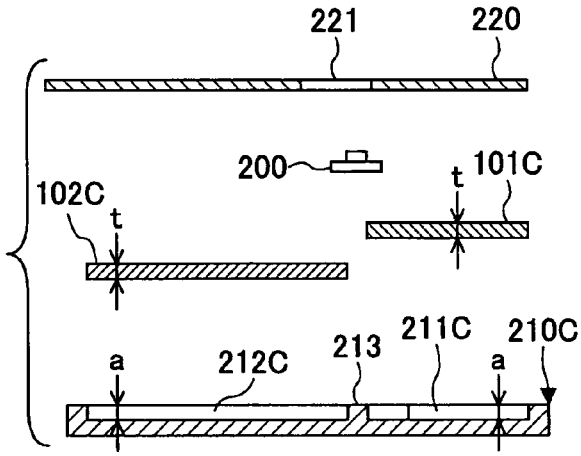
FIG. 13C is an exploded cross-sectional side view of the UWB planar antenna apparatus in FIG. 13A, cut across line B-B and viewed in the direction indicated by the arrows shown in FIG. 13A.
Figure 14:
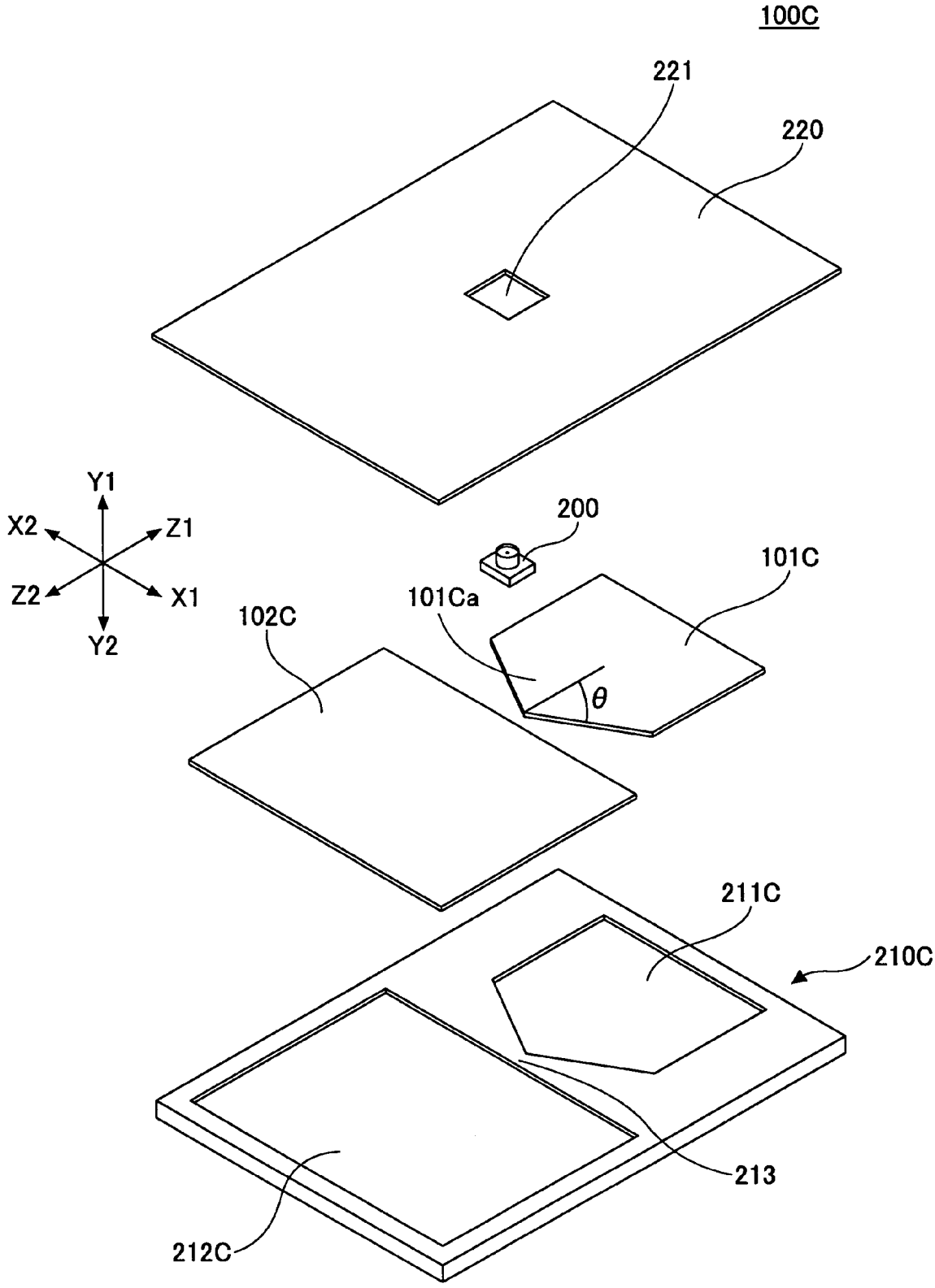
FIG. 14 is an exploded perspective view of the UWB planar antenna apparatus shown in FIG. 13A.

FIGS. 13A, 13B, and 13C are diagrams showing a UWB planar antenna apparatus 100C according to another embodiment of the present invention. Specifically, FIG. 13A is a perspective view of the UWB planar antenna apparatus 100C, FIG. 13B is a cross-sectional view of the UWB planar antenna apparatus 100C cut across line B-B of FIG. 13A, and FIG. 13C is an exploded cross-sectional side view of the UWB planar antenna apparatus 100C cut across line B-B and viewed in the direction indicated by the arrows shown in FIG. 13A. Also, FIG. 14 is an exploded perspective view of the UWB planar antenna apparatus 100C shown in FIG. 13A.

The UWB planar antenna apparatus 100C according to the present embodiment includes a case 210C, an antenna element 10C, and a ground element 102 that differ from the case 210, the antenna element 101, and the ground element 102 of the UWB planar antenna apparatus 100 shown in FIGS. 3A-3C.

The case 210C has an antenna element pocket 211C and a ground element pocket 212C on its upper face. The antenna element pocket 211C and the ground element pocket 212C are divided by a divider 213. The antenna element pocket 211C and the ground element pocket 212C have shapes corresponding to those of the antenna element 101C and the ground element 102C, respectively, and are positioned according to the positioning of the antenna element 101C and the ground element 102C within the UWB planar antenna apparatus 100C. Also, the antenna element pocket 211C and the ground element pocket 212C are arranged to have depth 'a' which is equal to thickness 't' of the antenna element 101C and the ground element 102C.

The antenna element 101C is a punched copper sheet element that is arranged into a home base shape. The antenna element 101C of the present embodiment does not include the strip line 101*b* of FIG. 5. Also, the opening angle θ of a protruding portion (power supply point) 101Ca of the antenna element 101C shown in FIG. 14 is arranged to be approximately 60 degrees.

The ground element 102C is arranged into a rectangle and does not include the concave portion 102*a* of FIG. 5.

The antenna element 101C and the ground element 102C are set in place by being fit into the pockets 211C and 212C, respectively. In this arrangement, the protruding portion (power supply point) 101Ca of the antenna element 101C is arranged close to the ground element 102C. The antenna element 101C and the ground element 102C are covered by a cover 220. A socket coaxial connector 200 is mounted over the antenna element 101C and the ground element 102C at the location of the protruding portion (power supply point) 101Ca, and the socket coaxial connector 200 is arranged to protrude from an opening 221 of the cover 220.

According to an aspect of the present embodiment, by dividing the pocket 211C and the pocket 212C by the divider 213, short circuit of the antenna element 101C and the ground element 102C may be prevented even when the antenna element 101C and the ground element 102C have burrs. It is noted that burrs may occur as a result of degradation of the mold used in a press process, for example.

As can be appreciated from the above descriptions, according to an aspect of the present invention, by using an antenna element and a ground element made of punched sheet metal, vapor deposition and etching that require many process steps do not have to be performed so that costs for fabricating the antenna apparatus may be reduced, for example.

According to another aspect of the present invention, by embedding the antenna element and the ground element in corresponding accommodating portions of a synthetic resin case, the embedding process may be accurately performed without having to consider insert molding conditions, for example.

Further, although the present invention is shown and described with respect to certain preferred embodiments, it is obvious that equivalents and modifications may occur to others skilled in the art upon reading and understanding the specification. The present invention includes all such equivalents and modifications, and is limited only by the scope of the claims.

What is claimed is:

1. An antenna apparatus, comprising:

a synthetic resin case having an antenna element accommodating portion and a ground element accommodating portion, which are disposed substantially in the same plane;

an antenna element made of punched sheet metal that is accommodated within the antenna element accommodating portion;

a ground element made of punched sheet metal that is accommodated within the ground element accommodating portion and aligned along a monopole axis with the antenna element;

a coaxial connector that is mounted on a top surface of an interface between the antenna element and the ground element; and a cover that covers the antenna element and the ground element.

2. The antenna apparatus as claimed in claim 1, wherein the synthetic resin case includes a divider that is arranged between the antennal element accommodating portion and the ground element accommodating portion.

3. The antenna apparatus as claimed in claim 1, wherein the cover is at least one of a synthetic resin cover, an insulating layer, and an insulating film formed through application of an insulating material on the antenna element and the ground element.

4. The antenna apparatus as claimed in claim 1, wherein the antenna element has a strip line portion that engages into a concave portion of the ground element.

5. The antenna apparatus as claimed in claim 1, wherein the cover has an opening in an area where the coaxial connector is mounted.

6. The antenna apparatus as claimed in claim 1, wherein the antenna apparatus has a multilayer flat structure including a first layer which is a bottom wall of the synthetic resin case, a second layer in which the antenna element and the ground element are arranged, and a third layer from which a first portion of the coaxial connector protrudes through the cover.

7. The antenna apparatus as claimed in claim 1, wherein the antenna element and the ground element have substantially the same thickness.

8. A method for fabricating an antenna apparatus, the method comprising the steps of:

embedding an antenna element made of punched sheet metal and a ground element made of punched sheet metal in a synthetic resin case by accommodating the antenna element within an antenna element accommodating portion of the synthetic resin case, accommodating the ground element within a ground element accommodating portion of the synthetic resin case, wherein the antenna element accommodating portion and the ground element accommodating portion substantially in the same plane, and aligning the antenna element and the ground element along a monopole axis;

mounting a coaxial connector on a top surface of an interface between the antenna element and the ground element; and covering the antenna element and the ground element with a cover.

* * * * *